United States Patent [19]

Kimura et al.

[11] 4,113,372

[45] Sep. 12, 1978

[54] PHOTOSENSITIVE SCREEN DRUM FOR ELECTROGRAPHIC APPARATUSES

[75] Inventors: Katsuhiko Kimura; Masaji Nishikawa, both of Hachioji, Japan

[73] Assignee: Olympus Optical Co., Ltd., Tokyo, Japan

[21] Appl. No.: 752,839

[22] Filed: Dec. 20, 1976

[30] Foreign Application Priority Data

Dec. 23, 1975 [JP] Japan ..... 50-152877

[51] Int. Cl.[2] ..... G03G 15/00

[52] U.S. Cl. ..... 355/3 SC; 29/123; 355/3 DR

[58] Field of Search ..... 355/3 R, 3 TR, 3 SC, 355/3 DR; 29/123

[56] References Cited

U.S. PATENT DOCUMENTS

| | | | |
|---|---|---|---|
| 3,536,397 | 10/1970 | Van Wagner | 355/3 DR |
| 3,898,085 | 8/1975 | Suzuki et al. | 355/3 SC X |
| 3,985,432 | 10/1976 | Hou et al. | 355/3 SC |

*Primary Examiner*—Fred L. Braun

*Attorney, Agent, or Firm*—Haseltine, Lake & Waters

[57] ABSTRACT

A photosensitive screen drum for electrographic apparatuses. The photosensitive screen drum comprises a photosensitive screen wound around a cylindrical supporting body composed of a pair of insulating discs rotatably mounted on a fixed shaft and spaced apart from each other and an electric conductive supporting member formed into an arcuate segment and connecting the insulating discs. The electric conductive supporting member is provided at least its inner surface with an insulating coating.

4 Claims, 4 Drawing Figures

PHOTOSENSITIVE SCREEN DRUM FOR ELECTROGRAPHIC APPARATUSES

This invention relates to a photosensitive screen drum for electrographic apparatuses.

An electrographic apparatus comprises a rotary photosensitive screen drum and a stationary cylindrical cover for surrounding the screen drum. In the screen drum are arranged a first corona discharge device and a second corona discharge device in the order described in a direction of rotation of the screen drum. The first corona discharge device functions to uniformly charge the screen drum. A manuscript to be reproduced is disposed on a carriage and held at a given position by a lid. The manuscript is illuminated by a lamp and reflected light from the manuscript is deflected by mirrors and projected through a window provided in the periphery of the cylindrical cover on the screen drum by a projection lens. As a result, an electric charge pattern corresponding to a manuscript image is formed on the screen drum. The screen drum with the electric charge pattern formed thereon is further rotated and reaches to the second corona discharge device and is opposed to an electrostatic record sheet fed on a conveyor belt from a cassette through a delivery roller. The conveyor belt functions also as a field electrode. Between the field electrode and the screen drum is applied a high voltage so as to accelerate a flow of ions directed from the second corona discharge device toward the record sheet. In this case, the flow of ions is controlled by the electric charge on the screen drum to form on the record sheet an electrostatic picture image corresponding to the image pattern of the manuscript. Then, the record sheet is fed to a developing tank where the electrostatic picture image formed on the record sheet is converted into a visible image. The record sheet is then delivered through a squeezing rollers and delivery rollers to a record sheet receiver.

The screen drum is composed of a thin sheet formed of metal or its alloy selected from the group consisting of copper, iron, stainless steel, nickel, chromium and alloys thereof and having a thickness of the order of several tens $\mu$ to several hundreds $\mu$. The thin sheet is provided with a number of holes etched, for example, by photoresist. On the thin sheet are superimposed a conductive coating, photoconductive coating and insulating coating one upon the other by spraying, painting or vacuum vapor deposition, etc.

In general, a photosensitive screen is supported by a cylindrical supporting body composed of a pair of discs and a supporting member for connecting those portions of peripheral edges of the discs which are opposed to each other. These discs and supporting member are made integral into one cylindrical supporting body. Heretofore, it has been the common practice to form such cylindrical supporting body with an insulating material such as plastics, etc. or with proper metals.

In the case of forming the cylindrical supporting body with the plastic insulating material, use is made, as the plastic insulating material, of phenol resin whose thermal expansion coefficient $\rho=30\times10^{-6}/°$ C. to $45\times10^{-6}/°$ C., polycarbonate resin whose thermal expansion coefficient $\rho=70\times10^{-6}/°$ C., etc. As a result, the thermal expansion coefficient of the cylindrical supporting body formed of the plastic insulating material is far different from thermal expansion coefficient $\rho=11.6\times10^{-6}/°$ C. of an electric conductive substrate formed of stainless steel of the photosensitive screen. In the ordinary temperature difference of 10° C. to 40° C., the amount of thermal expansion of the cylindrical supporting body becomes considerably different from the amount of thermal expansion in the axial direction of the photosensitive screen arranged diametrically opposed to the cylindrical supporting body. Thus, there is a risk of the screen drum being deformed or creased with wrinkles. As a result, a small gas defined between the photosensitive screen and the record sheet becomes changed. Thus, a secondary electrostatic latent image formed on the record sheet by controlling the flow of ions passing through the photosensitive screen becomes displaced. In addition, the photosensitive screen is arranged near a corona discharge wire, so that the above mentioned wrinkles formed on the photosensitive screen causes the distance between the photosensitive screen and the corona discharge wire to be nonuniform. In the worst case, a suitable corona discharge distance is not maintained therebetween thus inducing a spark discharge which breakes down the electrographic apparatus.

As one of the means of overcoming the above mentioned problem caused by the above mentioned thermal expansion difference, theretofore it has been proposed to firmly fix one of bearings for rotatably supporting the cylindrical supporting body such that the bearing could not be displaced in the axial direction thereof and make the other bearing movable in the axial direction thereof. In this case, however, the photosensitive screen becomes considerably displaced at that side thereof which is supported by the movable bearing due to thrust or thermal expansion subjected thereto, and as a result, the photosensitive screen could not be rotated along a given circular path. Thus, the above proposed means has led to unsatisfactory results and could not be used in practice.

An object of the invention, therefore, is to provide a photosensitive screen drum for electrographic apparatuses which can obviate the above mentioned disadvantage which has been encountered with other techniques.

A feature of the invention is the provision of a photosensitive screen drum for electrographic apparatuses comprising a casing, a fixed shaft secured to the casing, a cylindrical supporting body composed of a pair of insulating discs rotatably mounted on the fixed shaft and spaced apart from each other, an electric conductive supporting member secured at its both ends to those peripheral edges of the insulating discs which are opposed to each other and connecting the insulating discs, said electric conductive supporting member being provided at least on inner surface thereof with an insulating coating formed thereon and a photosensitive screen wound around the cylindrical supporting body and secured at its both ends thereto.

The invention will now be described in greater detail with reference to the accompanying drawings, wherein.

Figure 1:
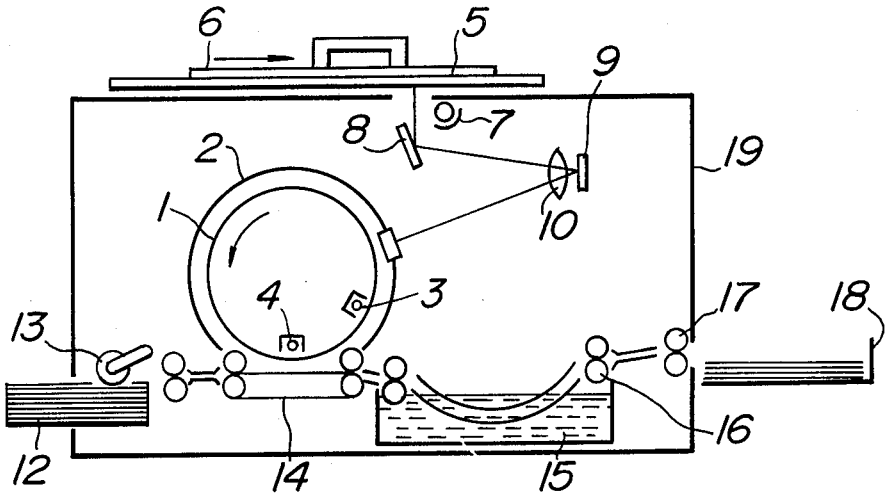
FIG. 1 is a diagrammatic cross sectional view showing an electrographic apparatus wherein a photosensitive screen drum according to the invention is used.

Referring FIG. 1, reference numeral 1 designates a mesh-shaped photosensitive screen formed into drum-like configuration and rotatable in a direction shown by an arrow, 2 a surrounding cover which is stationary with respect to the screen 1, 3 a first corona discharge device arranged inside the screen 1 and uniformly charging it and 4 a second corona discharge device arranged inside the screen 1 and directing a flow of ions toward a record sheet, 5 a carriage on which is disposed a manuscript to be reproduced and which is movable in a direction shown by an arrow when the manuscript is reproduced, 6 a lid for holding the manuscript at a given position on the carriage 5, 7 a lamp for illuminating the manuscript, 8 and 9 mirrors for deflecting reflected light from the manuscript, 10 a projection lens for projecting the reflecting light onto the screen 1, 11 a window provided in the surrounding cover 2 and permitting the reflected light to pass therethrough, 12 a cassette for enclosing record sheets therein, 13 a delivering roller for feeding a record sheet from the cassette 12, 14 a conveyor belt opposed to the second corona discharge device 4 and served also as a field electrode, 15 a developing tank for converting the electrostatic picture image formed on the record sheet into a visible image, 16 squeezing rollers, 17 delivering rollers, 18 a record sheet receiver and 19 a casing of the electrographic apparatus.

Figure 2:
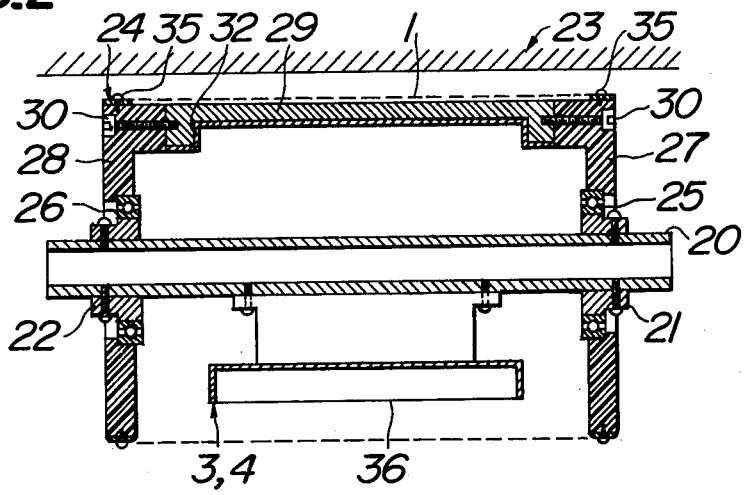
FIG. 2 is a cross sectional view showing a photosensitive screen drum according to the invention.

In FIG. 2 is shown a photosensitive screen drum according to the invention. Reference numeral 20 designates a hollow fixed shaft firmly secured to the casing 19 of the electrographic apparatus shown in FIG. 1. 21 and 22 show end rings spaced apart from each other and firmly fitted around the fixed shaft 20. 23 is a field electrode corresponding to the conveyor belt 14 shown in FIG. 1. A cylindrical supporting body 24 is rotatably journaled in bearings 25, 26 which are firmly secured through the end rings 21, 22 to the fixed shaft 20, and as a result, the cylindrical supporting body 24 is not displaced in the axial direction of the fixed shaft 20.

The cylindrical supporting body 24 is composed of a pair of insulating discs 27, 28 each formed of phenol resin, polycarbonate resin, Teflon (Polytetrafluoroethylene), derlin, etc. and an electric conductive supporting member 29 connected at its both ends to the opposed outer peripheral edges of the insulating discs 27, 28. The electric conductive supporting member 29 may be formed of material which is the same as that of the substrate of the photosensitive screen 1, for example, stainless steel. The electrode conductive supporting member 29 is connected at its both ends to the insulating discs 27, 28 by means of bolts 30.

Since the electric conductive supporting member 29 is formed of metal, a spark discharge is liable to be occurred from the corona discharge wire 36 through air and the field electrode 23 to the record sheet during rotation of the screen 1 thus rendering it difficult to effect a given reproduction.

Figure 3:
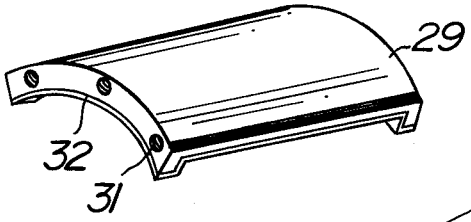
FIG. 3 is a perspective view showing an electric conductive supporting member shown in FIG. 2.

As shown in FIG. 3, the electric conductive supporting member 29 is formed into an arcuate segment and provided at its ends with tapped holes 31 threadedly engageable with the bolts 30 extending through the insulating disc 27 and at its inner surface with an insualting coating 32 formed of parilen, Tefflon (polytetrafluoroethylene), derlin, acryl by vapor deposition, cementing or any other process. Alternatively, the electric conductive supporting member 29 may be covered at its overall surface with the insulating coating 32.

Figure 4:
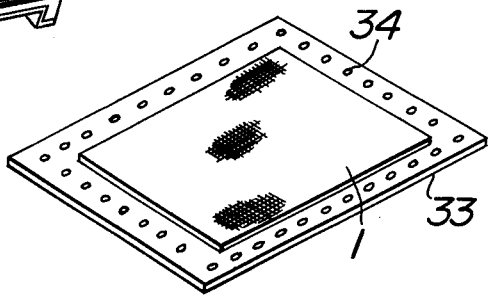
FIG. 4 is a perspective view showing a photosensitive screen adapted to be wound around the cylindrical supporting body shown in FIG. 2.

In order to wind the photosensitive screen 1 about the cylindrical supporting body 24 constructed as above described, a flat rectangular photosensitive screen 1 is secured at its four sides to a rectangular frame 33 provided with a number of small holes 34 as shown in FIG. 4. The frame 33 with the photosensitive screen 1 is wound around the cylindrical supporting body 24 and firmly secured thereto by means of small screws 35 extended through the small holes 34 and screwed into the cylindrical supporting body 24 as shown in FIG. 2, thereby providing a photosensitive screen drum according to the invention as shown in FIG. 2.

In the photosensitive screen drum constructed as above described in accordance with the invention, the amount of thermal expansion of the screen 1 produced in its axial direction becomes substantially equal to the amount of thermal expansion produced in the electric conductive supporting member 29, and as a result, there is no risk of the screen 1 being deformed. Thus, a distance between the screen 1 and the record sheet on the one hand and a distance between the screen 1 and a corona discharge wire 36 (FIG. 2) of the corona discharge device 3, 4 on the other hand can be kept constant and hence it is possible to avoid any displacement of the electrostatic latent image produced in the photosensitive screen 1 and also avoid any other failures of the electrographic apparatus.

In addition, the electric conductive supporting member 29 is formed of electric conductive material and provided at its inner surface with the insulating coating 32, so that it is possible to positively prevent spark discharge from being produced in the case of directing a flow of ions from the corona discharge device 4 toward the record sheet.

What is claimed is:

1. A photosensitive screen drum for electrographic apparatuses comprising: a casing; a fixed shaft secured to said casing; a cylindrical supporting body composed of a pair of insulating discs rotatably mounted on said fixed shaft and spaced apart from each other, and an electrically conductive supporting member secured at its both ends to said insulating discs, said electrically conductive supporting member being formed into an arcuate segment having at least an inner surface thereof with an insulating coating formed thereon; and a photosensitive screen wound around said cylindrical supporting body and secured at both ends thereto; said supporting member being formed of the same material and having the same thermal expansion coefficient as said photosensitive screen.

2. A photosensitive screen drum for electrographic apparatuses as claimed in claim 1, wherein: said electrically conductive supporting member formed into an arcuate segment is provided at both ends with tapped holes threadedly engageable with bolts extending through said insulating disc and having said insulating coating at its inner surface.

3. A photosensitive screen drum for electrographic apparatuses as claimed in claim 2, wherein: said arcuate segment is provided with said insulating coating along its overall surface.

4. A photosensitive screen drum for electrographic apparatuses as claimed in claim 1, wherein: said photosensitive screen is formed into a flat rectangular photosensitive screen secured at its four sides to a rectangular frame, said frame with said screen being wound around said cylindrical supporting body.

* * * * *